US008291875B2

(12) United States Patent
Yang et al.

(10) Patent No.: US 8,291,875 B2
(45) Date of Patent: Oct. 23, 2012

(54) CONTINUOUSLY VARIABLE VALVE LIFT DEVICE FOR VEHICLE

(75) Inventors: Jei Choon Yang, Yongin-si (KR); Byong Young Choi, Incheon (KR); Young Hong Kwak, Suwon-si (KR); Ki Young Kwon, Seoul (KR); Jin Kook Kong, Suwon-si (KR); Soo Hyung Woo, Yongin-si (KR); Jin Soon Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 420 days.

(21) Appl. No.: 12/625,233

(22) Filed: Nov. 24, 2009

(65) Prior Publication Data

US 2011/0036317 A1 Feb. 17, 2011

(30) Foreign Application Priority Data

Aug. 12, 2009 (KR) ..... 10-2009-0074176

(51) Int. Cl.
*F01L 1/34* (2006.01)

(52) U.S. Cl. ..... 123/90.16; 123/90.39

(58) Field of Classification Search ..... 123/90.16, 123/90.39; 74/559, 569
See application file for complete search history.

(56) References Cited

U.S. PATENT DOCUMENTS 6,694,935 B2 * 2/2004 Miyazato et al. ..... 123/90.16
7,322,325 B1 * 1/2008 Mueller ..... 123/90.16

FOREIGN PATENT DOCUMENTS

JP 1 1-2941 25 A 10/1999
JP 2001-123809 A 5/2001
JP 2004-360467 A 12/2004
JP 2005-201149 A 7/2005
JP 2008-25441 A 2/2008

* cited by examiner

*Primary Examiner* — Zelalem Eshete
(74) *Attorney, Agent, or Firm* — Morgan, Lewis & Bockius LLP

(57) ABSTRACT

A continuously variable valve lift device for a vehicle is provided, which includes a drive shaft rotating in association with a crank shaft and having a drive cam formed on an outer periphery thereof, a locker arm shaft provided apart from the drive shaft and having one end that supports a rocker arm rotating and rocking in association with the drive cam, output cams rotatably installed on the drive shaft to interlock with the other end of the rocker arm, and a variable drive part straightly moving the rocker arm shaft in a vertical direction of the rocker arm shaft to vary a valve lift. When a valve is shifted from the high-lift state to the low-lift state, a pumping loss is reduced to improve the fuel consumption ratio. Also, since an advance function is provided, an exhaust-side CVVT can be deleted to greatly reduce the manufacturing cost.

12 Claims, 6 Drawing Sheets

CONTINUOUSLY VARIABLE VALVE LIFT DEVICE FOR VEHICLE

CROSS-REFERENCE TO RELATED APPLICATION

The present application claims priority of Korean Patent Application Number 10-2009-0074176 filed Aug. 12, 2009, the entire contents of which application is incorporated herein for all purposes by this reference.

BACKGROUND OF THE INVENTION

1. Field of the Invention

The present invention relates to a continuously variable valve lift device for a vehicle, and more particularly, to a continuously variable valve lift device for a vehicle, which can vary the lift amount of valves according to engine operating state.

2. Description of Related Art

According to a general cam provided in a conventional engine, it is impossible to change a valve lift and duration. In addition, since it is required to fix a fixed valve lift and duration to a specified number of rotations, the fuel consumption ratio and output optimization cannot be sought.

Recently, in order to improve the fuel consumption ratio and output, attempts to vary the valve lift and an opening/closing period of intake/exhaust valves have been actively made, and one of devices developed as a part of such efforts is a continuously variable valve lift (CVVL) device.

That is, the continuously variable valve lift device can optimally control the valve operation such as the valve lift and the opening/closing period of the intake/exhaust valves in accordance with operational conditions of the engine. Specifically, the continuously variable lift device can maximize a flow rate of an intake air at high speed/high load requiring high output, and minimize an effect of EGR (Exhaust Gas Recirculation) or a loss of throttle at low speed/low load where it is important to improve the fuel consumption ratio or to reduce the exhaust gas.

According to the conventional variable valve lift device, however, an advance function is not provided, and due to a short a period where the intake valve and the exhaust vale overlap each other, the fuel consumption ratio can be improved only by applying the exhaust-side CVVT.

In addition, when the valve is lifted, an open duration becomes longer than a close duration to deteriorate the dynamic characteristics such as the acceleration characteristics and so on, and the valve duration is lengthened to lower the performance and the fuel consumption ratio.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention solve the above-mentioned problems occurring in the prior art while advantages achieved by the prior art are maintained intact.

One aspect of the present invention provides for a continuously variable valve lift device for a vehicle, which can improve the fuel consumption ratio by reducing a pumping loss through an advance function provided therein.

Another aspect of the present invention provides for a continuously variable valve lift device for a vehicle, which can improve dynamic characteristics such as acceleration characteristics by making a close duration longer than an open duration when a valve is lifted, and can heighten the performance and the fuel consumption ratio by minimizing the valve duration.

A continuously variable valve lift device for a vehicle, according to various embodiments of the present invention may include a drive shaft rotating in association with a crank shaft and having a drive cam formed on an outer periphery thereof, a locker arm shaft provided apart from the drive shaft and having one end that supports a rocker arm rotating and rocking in association with the drive cam, output cams rotatably installed on the drive shaft to interlock with the other end of the rocker arm, and/or a variable drive part straightly moving the rocker arm shaft in a vertical direction of the rocker arm shaft to vary a valve lift.

The drive cam may be formed eccentrically from the center of the drive shaft, and an outer vibrating race connected to the one end of the rocker arm via a connection shaft may be assembled in the drive cam so as to be freely rotatable in the drive cam.

The continuously variable valve lift device according to various embodiments of the present invention may further include an output cam link transferring the rotation of the rocker arm to the output cam, wherein one end of the output cam link is connected to the other end of the rocker arm through a first link shaft, and the other end thereof is connected to the output cam through a second link shaft.

When the valve is in a high-lift state or in a low-lift state, a shaft line A connecting the drive shaft to the rocker arm shaft may be arranged to cross a shaft line B connecting the first link shaft to the second link shaft.

Here, the variable drive part may include a control shaft having an outer periphery on which an eccentric control cam is formed and arranged in parallel to the rocker arm shaft, a control link connected to the eccentric control cam and the rocker arm shaft, and/or a motor unit rotating the control shaft.

The continuously variable valve lift device according to various embodiments of the present invention may further include a guide part guiding the rocker arm shaft when the rocker arm shaft moves to slide in forward and backward directions by a rotating force of the control shaft.

The guide part may include a housing having elongated holes formed in forward and backward directions on both sides thereof and a guide hole formed therein to make the rocker arm shaft movable, and/or a guide member supporting the rocker arm shaft through the inner hole and guiding the rocker arm shaft as moving in forward and backward directions along the guide hole.

On the other hand, the variable drive part may include a housing having elongated holes formed in forward and backward directions on both sides thereof and a hydraulic chamber formed therein to make the rocker arm shaft movable, a piston supporting the rocker arm shaft through the inner hole, and moving in forward and backward directions in the hydraulic chamber by hydraulic pressure, and/or an elastic member provided in the housing to constantly push the piston in forward direction.

The variable drive part may further include an oil control valve changing directions, wherein when the valve is in high-lift state, oil supplied from an oil pump to the oil control valve through a first hydraulic line is supplied to the hydraulic chamber through a second hydraulic line to move the piston in forward direction and then is withdrawn to the oil control valve through a third hydraulic line to be drained, while when the valve is in low-lift state, the oil supplied from the oil pump to the oil control valve through the first hydraulic line is supplied to the hydraulic chamber through the third hydraulic line to move the piston in backward direction and then is withdrawn to the oil control valve through the second hydraulic line to be drained.

The variable drive part may further include an oil control valve changing directions, and first and second one-way check valves, wherein when the valve is in high-lift state, oil supplied from an oil pump to the oil control valve through a first hydraulic line is supplied to the hydraulic chamber through a second hydraulic line by opening the first check valve, and when the rocker arm shaft is moved in forward direction by a change of a driving torque of the valve, the oil is withdrawn to the oil control valve through a third hydraulic line and then flows again to the second hydraulic line, while when the valve is in low-lift state, the oil supplied from the oil pump to the oil control valve through the first hydraulic line is supplied to the hydraulic chamber through a fourth hydraulic line by opening the second check valve, and when the rocker arm shaft is moved in backward direction by the change of the drive torque of the valve, the oil is withdrawn to the oil control valve through a fifth hydraulic line and then flows again to the fourth hydraulic line.

A backward flow prevention valve may be installed on the first hydraulic line.

In another aspect of the present invention, a continuously variable valve lift device for a vehicle may include a drive shaft having a drive cam which is formed on an outer periphery thereof and on which an outer vibrating race is rockably installed, a locker arm shaft provided apart from the drive shaft and having a rocker arm rotatably installed thereon to interlock with the outer vibrating race, output cams rotatably installed on the drive shaft to interlock with the rocker arm, and/or an output cam link having one end connected to the rocker arm through a first link shaft and the other end connected to the output cam through a second link shaft, wherein when the valve is in a high-lift state or in a low-lift state, a shaft line A connecting the drive shaft to the rocker arm shaft may be arranged to cross a shaft line B connecting a first link shaft to a second link shaft.

As described above, according to the present invention, when the valve is shifted from a high-lift state to a low-lift state, the pumping loss is reduced, and thus the fuel consumption ratio is improved.

Also, when the valve is lifted, a shaft line A connecting the drive shaft to the rocker arm shaft is arranged to cross a shaft line B connecting the first link shaft to the second link shaft. Accordingly, the close duration becomes longer than the open duration, and thus dynamic characteristics such as acceleration characteristics can be improved, and the valve duration can be minimized to heighten the performance and the fuel consumption ratio.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
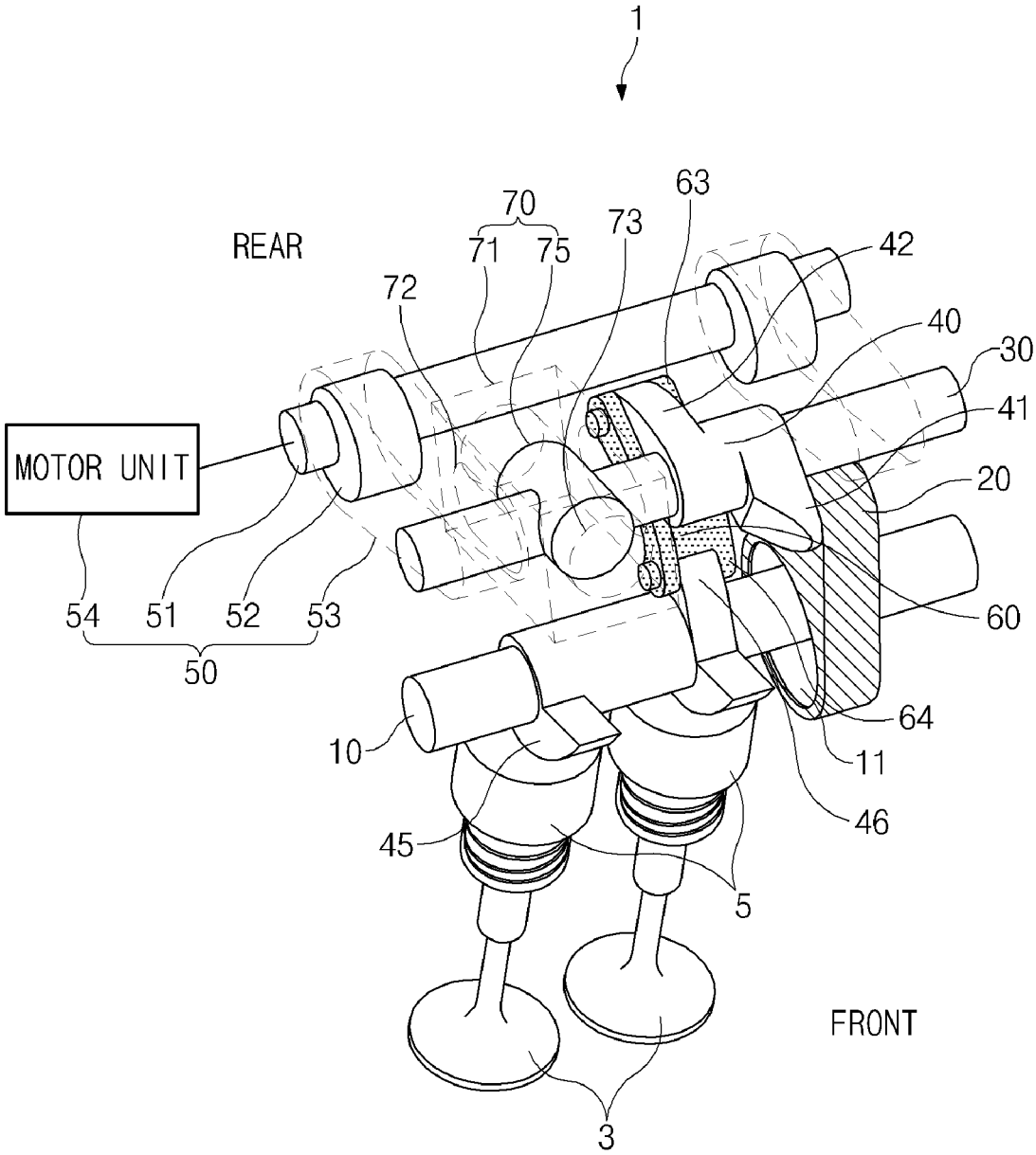
FIG. 1 is a perspective view illustrating an exemplary continuously variable valve lift device for a vehicle according to the present invention.

FIG. 1 is a perspective view illustrating a continuously variable valve lift device for a vehicle according to various embodiments of the present invention.

As illustrated in FIG. 1, the continuously variable valve lift device 1 for a vehicle according to various embodiments of the present invention includes a drive shaft 10, an outer vibrating race 20 rockably installed on a drive cam 11 formed on an outer periphery of the drive shaft 10, a rocker arm shaft 30 provided apart from the drive shaft 10, a rocker arm 40 rotatably installed on the rocker arm shaft 30 to interlock with the outer vibrating race 20, output cams 45 rotatably installed on the drive shaft 10, and a variable drive part 50 for varying a valve lift by straightly moving the rocker arm shaft 30 in a vertical direction of the rocker arm shaft 30.

The drive shaft 10 is rotated in association with a crank shaft, and on the outer periphery of the drive shaft 10, a drive cam 11, which is formed eccentrically from the center of the drive shaft 10 and on which the outer vibrating race 20 is installed, is formed. When the drive shaft 10 is rotated, the outer vibrating race 20 is rocked in every direction along a profile of the drive cam 11.

Also, on the drive shaft 10, two output cams 45 corresponding to two intake valves 3 are rotatably mounted.

The output cam 45 is in contact with a tappet 5 connected to an upper end of the intake valve 3, and lifts the intake vale 3 by pressing the tappet 5 along the profile of the output cam 45. On the other hand, on one side of the output cam 45, a coupling piece 46, which is coupled to the other end 64 of an output cam link 60 to be described later and a second link shaft 62 (See FIG. 2A), is formed to project upward.

The locker arm shaft 30 is arranged on the upper side of the drive shaft 10 in parallel to the drive shaft 10. The rocker arm 40 is rotatably coupled to one side of the outer periphery of the rocker arm shaft 30, and a guide member 75 to be described later is coupled in a body with the other side of the outer periphery of the rocker arm shaft 30 in a horizontal direction.

The rocker arm 40, which is connected to the outer vibrating race 20, is rotated about the rocker arm shaft 30 as the outer vibrating race 20 is rocked, and transfers the rotating force to the output cam 45 via the output cam link 60. For this, one end 41 of the rocker arm 40 is connected to the outer vibrating race 20 through a connection shaft 21 (See FIG. 2A), and the other end 42 thereof is connected to one end 63 of the output cam link 60 through a first link shaft 61 (See FIG. 2A).

The output cam link 60 is a component for transferring the rotation of the rocker arm 40 to the output cam 45. One end 63 of the output cam link 60 is connected to the other end 42 of the rocker arm 40 through the first link shaft 61, and the other end 64 thereof is connected to the coupling piece 46 of the output cam 45 through the second link shaft 62.

Here, when the intake valve 3 is in a high-lift state or in a low-lift state, it is preferable that a shaft line B connecting the first link shaft 61 to the second link shaft 62 is arranged to cross a shaft line A connecting the drive shaft 10 to the rocker arm shaft 30. In this case, the rotating directions of the rocker arm 40 and the output cam 45 are contrary to each other, and thus the variation characteristics of the valve lift can be optimized (See FIGS. 2B and 3B).

More specifically, in a valve profile period (i.e. when the valve 3 is lifted), a close duration should be longer than an open duration in order to improve the dynamic characteristics such as acceleration characteristics. For this, the shaft line A and the shaft line B cross each other as in the present invention.

In addition, as the shaft line A crosses the shaft line B, the valve duration is minimized to improve the performance (effected by the high-lift duration) and the fuel consumption ratio (effected by the low-lift duration). Also, an operation angle of the output cam 45 for generating the lift of the valve 3 can be optimized.

The variable drive part 50 serves to shift the intake valve 3 from the high-lift state to the low-lift state and to make the output cam 45 advanced by straightly sliding the rocker arm shaft 30 in forward and backward directions (i.e. in vertical direction with respect to the rocker arm shaft 30).

For this, the variable drive part 50 roughly includes a control shaft 51 having an outer periphery on which an eccentric control cam 52 is formed, a control link 53 connecting the eccentric control cam 52 to the rocker arm shaft 30, and a motor unit 54 for rotating the control shaft 51.

The control shaft 51 is arranged on the upper side of the drive shaft 10 in parallel to the rocker arm shaft 30, and is rotated by the rotating force of the motor unit 54 to straightly move the rocker arm shaft 30 in forward and backward directions.

The control link 53 connects the eccentric control cam 52 to the rocker arm shaft 30, and makes the rocker arm shaft 30 movable in forward and backward directions by the rotating force of the control shaft 51.

Figure 2A:
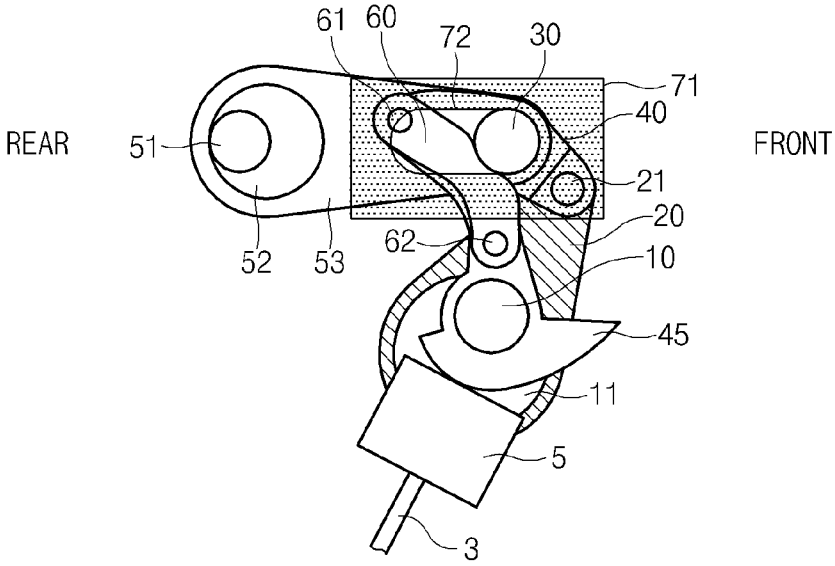
FIG. 2A is a side view showing an initial state of the continuously variable valve lift device of FIG. 1.
Figure 2B:
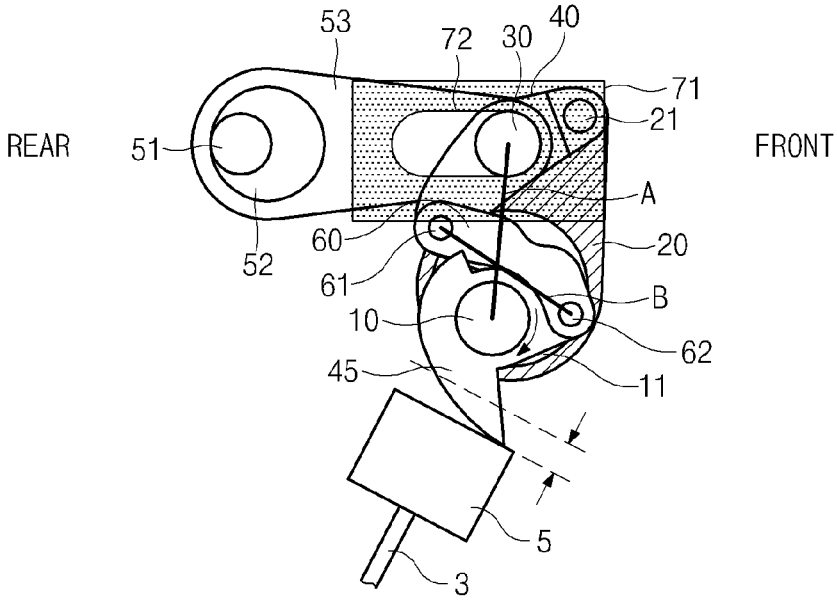
FIG. 2B is a side view showing a valve of FIG. 2A in a high-lift state.
Figure 3A:
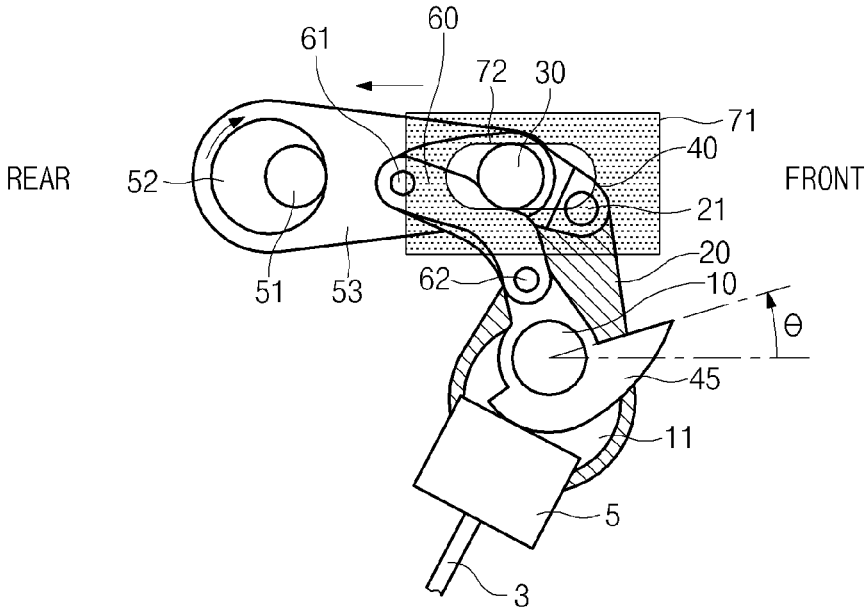
FIG. 3A is a side view showing output cams in an advance state when a drive shaft of FIG. 1 is rotated by 180° and a rocker arm shaft is moved straight in a left direction.
Figure 3B:
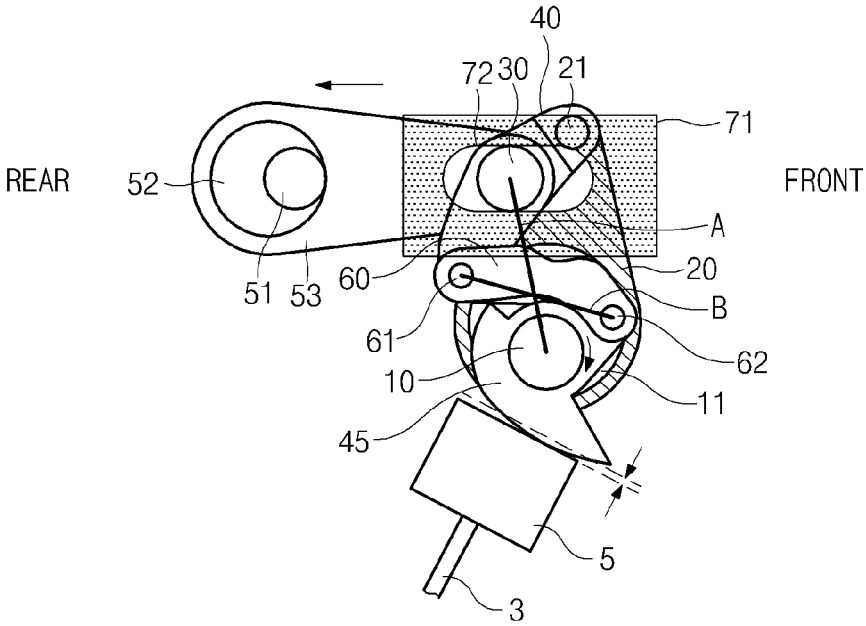
FIG. 3B is a side view showing a valve of FIG. 3A in low-lift state.

That is, an initial state where the control shaft 51 is not rotated is as shown in FIGS. 2A and 2B. In this case, the rocker arm shaft 30 is positioned in the foremost front. However, if the control shaft 51 is rotated by about 180°, the control link 53 pulls the rocker arm shaft 30 backward as shown in FIGS. 3A and 3B.

The motor unit 54, although simply illustrated in the drawing, is composed of a motor having a motor shaft on which a worm gear is formed, a worm wheel engaged with the work gear to rotate the control shaft 51, and a motor housing forming the exterior of the components. If the motor is driven, the worm wheel is rotated by the motor shaft, and thus the control shaft 51 is rotated in association with the worm wheel.

Here, it is preferable that a guide part 70 is further provided to guide the rocker arm shaft 30 when the rocker arm shaft 30 moves to slide in forward and backward directions by the rotating force of the control shaft 51.

The guide part 70 includes a housing 71 supported by a cylinder head and so on, and a guide member 75 provided inside the housing 71 to support the rocker arm shaft 30 through an inner hole (not illustrated). The guide part 70 prevents at maximum the rocker arm shaft 75 from being rocked when the rocker arm shaft 30 is slid in forward and backward directions.

On both sides of the housing 71, elongated holes 72 are formed in forward and backward directions, and a guide hole 73 is formed therein to communicate with the elongated holes 72. The rocker arm shaft 30 can be slid in forward and backward directions along the elongated holes 72, and the guide member 75 can be slid along the guide hole 73.

With reference to FIGS. 2A to 3B, the principle of lifting the valve 3 in the continuously variable valve lift device 1 according to various embodiments of the present invention will now be described.

A base state where the valve 3 is not lifted is as shown in FIG. 2A. In this case, the control shaft 51 is not rotated, and the rocker arm shaft 30 is positioned in the foremost front in the elongated hole 72.

Then, if the drive shaft 10 is rotated clockwise by about 180°, the outer vibrating race 20 is rocked by the rotating force thereof. In this case, as shown in FIG. 2B, the rocker arm 40 and the output cam link 60 are rotated counterclockwise, and in association with this, the output cam 45 is rotated clockwise by about 90° to make the valve 3 in the high-lift state.

On the other hand, if the control shaft 51 is rotated by about 180° by driving the motor unit 54 to make the valve in the low-lift state, the control link 53 is moved backward as shown in FIG. 3A, and in association with this, the rocker arm shaft 30 is slid backward for a specified distance along the elongated hole 72. Consequently, the hinge point (i.e. the rocker arm shaft 30) of the rocker arm 40 is moved, and in association with this, the outer vibrating race 20 and the output cam 45 are rotated counterclockwise to vary the output cam 45 by a specified angle □ as compared with the output cam in FIG. 2A.

Then, if the drive shaft 10 is rotated clockwise by about 180°, the outer vibrating race 20 is rocked by the rotating force thereof. In this case, as shown in FIG. 3B, the rocker arm 40 and the output cam link 60 are rotated counterclockwise, and in association with this, the output cam 45 is rotated clockwise by about 90° to make the valve 3 in the low-lift state.

Figure 4:
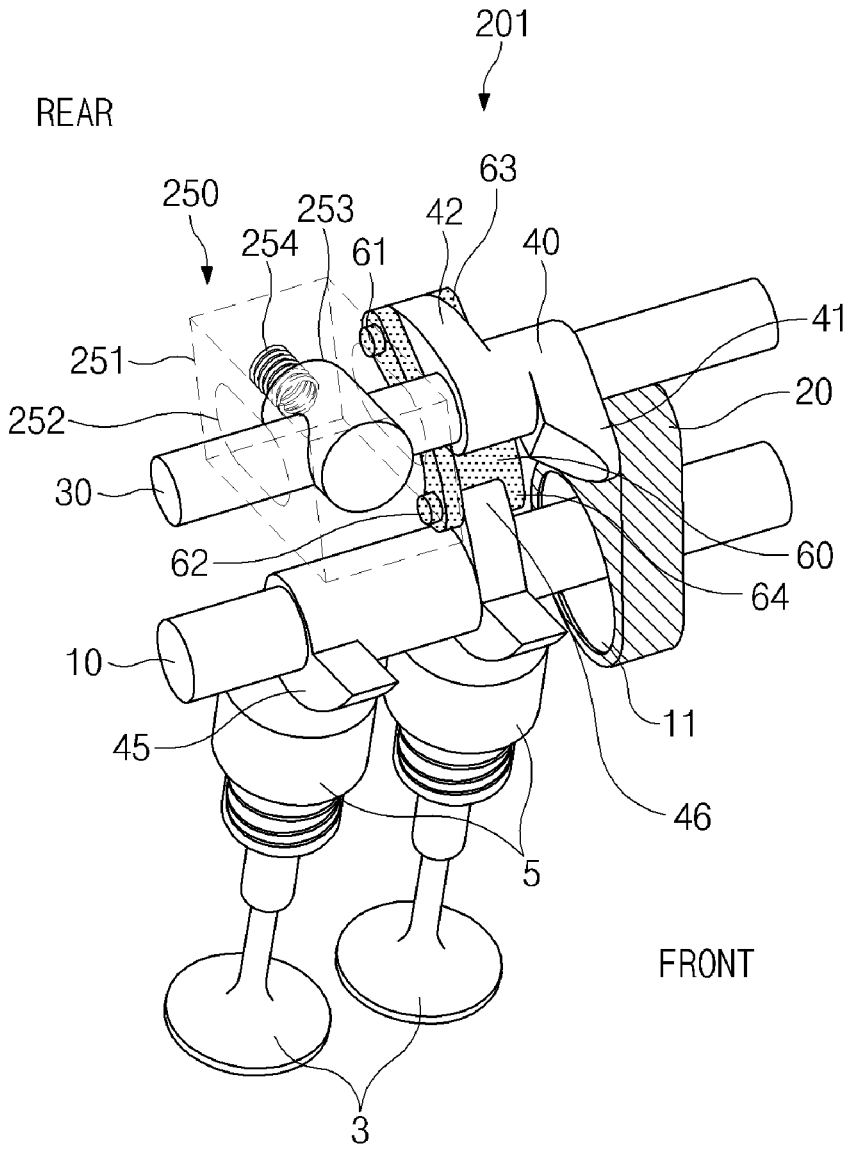
FIG. 4 is a perspective view schematically illustrating another exemplary continuously variable valve lift device for a vehicle according to the present invention.

On the other hand, the continuously variable valve lift device may be constructed as shown in FIG. 4.

Since the construction of the continuously variable valve lift device 201 according to other embodiments of the present invention, except for a variable drive part 250, is the same as that according to the above described embodiments of the present invention, explanation will be made, giving the first consideration to the variable drive part 250.

In the above described embodiments of the present invention, the variable drive part 50 is composed of the control shaft 51, the control link 53, and the motor unit 54, and the control shaft 51 is rotated by the motor unit 54 to move the rocker arm shaft 30 straight. By contrast, in other embodiments of the present invention, the variable drive part 250 excludes the control shaft 30, the control link 53, and the motor unit 54, and moves the rocker arm shaft 30 straight using a hydraulic pressure. Accordingly, the number of components is greatly reduced, and thus the manufacturing cost is reduced in comparison to that in the above described embodiments.

More specifically, the variable drive unit 250 is composed of a housing 251 in which a hydraulic chamber 250*a* (See FIG. 5A) is formed, a piston 253 moved by the hydraulic pressure in forward and backward directions in the hydraulic chamber 250*a*, and an elastic member 254 provided in the housing 251 to constantly push the piston 253 in forward direction.

The housing 251 serves to guide the piston 253 and the rocker arm shaft 30 when they move in forward and backward directions. Elongated holes 252 are formed in forward and backward directions on both sides of the housing 251 so as to move the rocker arm shaft 30 therethrough, and the hydraulic chamber 250*a* is formed therein to move the piston 253 by the hydraulic pressure.

Figure 5A:
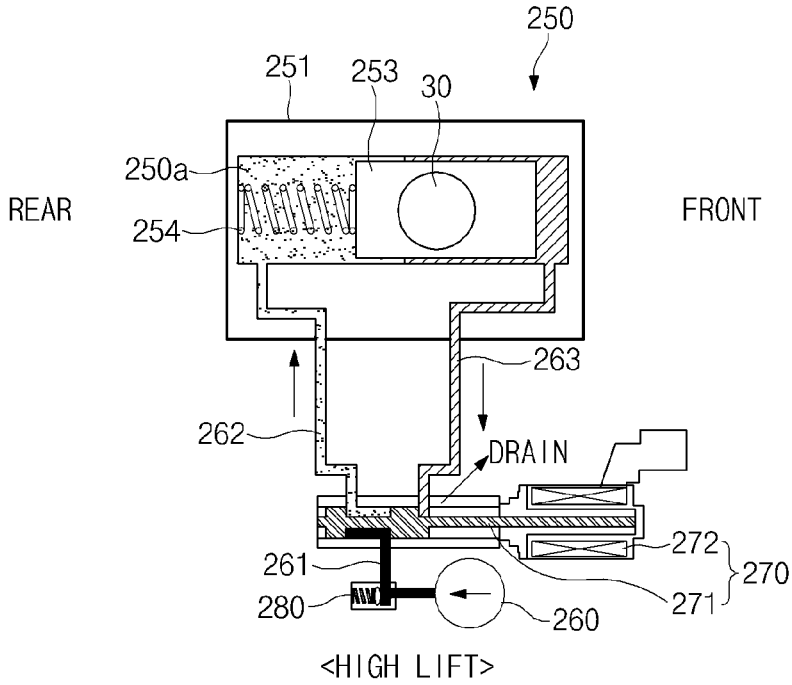
FIG. 5A is a hydraulic circuit diagram explaining the principle of supplying hydraulic pressure to a variable drive part of FIG. 4 when the valve is in high-lift state.
Figure 5B:
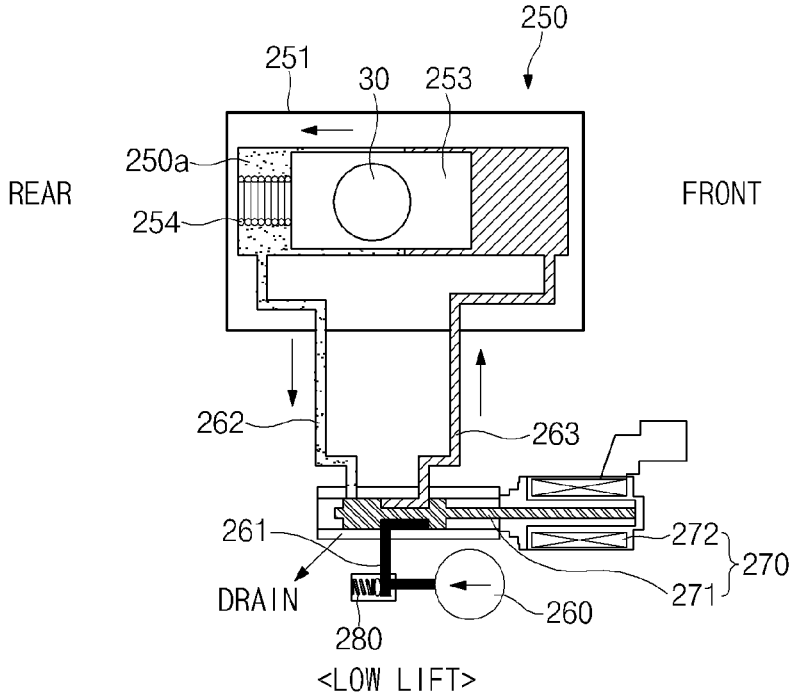
FIG. 5B is a hydraulic circuit diagram explaining the principle of supplying hydraulic pressure to a variable drive part of FIG. 4 when the valve is in low-lift state.

The principle of supplying the hydraulic pressure to the variable drive part 250 is as shown in FIGS. 5A and 5B.

FIG. 5A shows the state where the hydraulic pressure is supplied to the hydraulic chamber 250*a* when the valve 3 is in the high-lift state, and FIG. 5B shows the state where the hydraulic pressure is supplied to the hydraulic chamber 250*a* when the valve 3 is in the low-lift state.

When the valve 3 is in the high-lift state, oil pumped from an oil pump 260 is supplied to an oil control valve 270 through a first hydraulic line 261, and then is supplied to the hydraulic chamber 250*a* through a second hydraulic line 262. In this case, the piston 253 and the rocker arm shaft 30 are pushed in the foremost front by the hydraulic pressure, and the elastic member 254 is also released in the front. The oil, having pressed the piston 253 in the front, is withdrawn to the oil control valve 270 through a third hydraulic line 263, and then is drained (See FIG. 5A).

Here, the oil control valve 270 is driven as a general solenoid, and is composed of a spool valve 271 and a solenoid part 272 driven by current to move the spool valve 271 in forward and backward directions.

On the other hand, when the valve 3 is in the low-lift state, the oil is supplied to the hydraulic chamber 250*a* in an apposite process to the high-lift state. The details thereof will now be described.

When the valve 3 is in the low-lift state, the spool valve 271 is moved backward, and the oil pumped from the oil pump 260 is supplied to the oil control valve 270 through the first hydraulic line 261, and then is supplied to the hydraulic chamber 250*a* through the third hydraulic line 263. In this case, the piston 253 and the rocker arm shaft 30 are pushed backward at maximum by the hydraulic pressure, and the elastic member 254 is also in a compressed state by the pressing force of the piston 253. The oil, having pressed the piston 253 backward, is withdrawn to the oil control valve 270 through the second hydraulic line 262, and then is drained (See FIG. 5B).

Here, it is preferable that a backward flow prevention valve 280 is provided in the first hydraulic line 261. The backward flow prevention valve 280 is a one-way check valve that prevents the oil supplied from the oil pump 260 to the oil control valve 270 from flowing in backward direction.

In the structure where the oil withdrawn to the oil control valve 270 is drained (i.e. open type hydraulic circuit) as described above, it is required that the oil pump 260 continuously supplies the oil to the oil control valve 270 through the first hydraulic line 261.

Figure 6A:
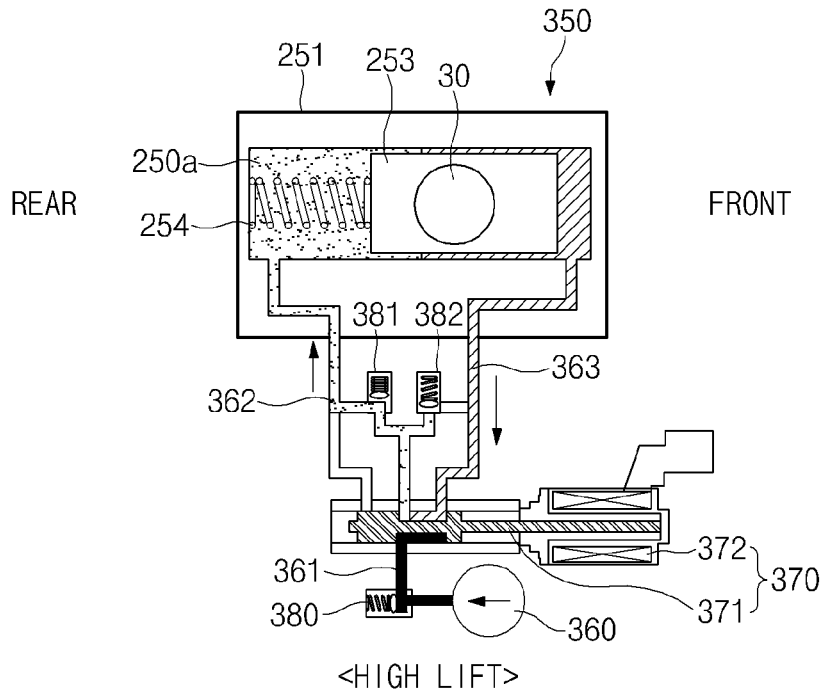
FIG. 6A is a hydraulic circuit diagram explaining the principle of supplying hydraulic pressure to a variable drive part when the valve is in high-lift state in another exemplary continuously variable valve lift device for a vehicle according to the present invention.
Figure 6B:
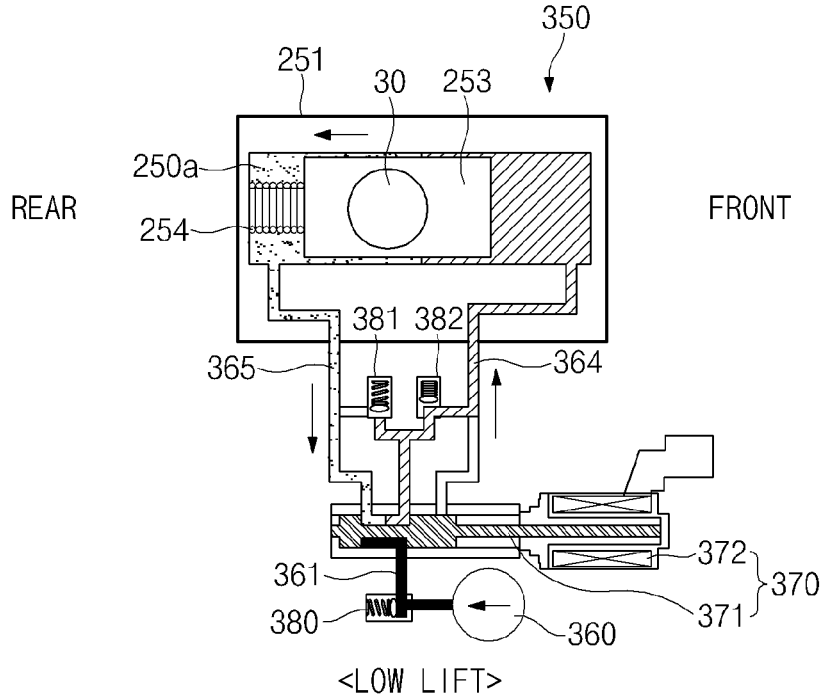
FIG. 6B is a hydraulic circuit diagram explaining the principle of supplying hydraulic pressure to a variable drive part when the valve is in low-lift state in the continuously variable valve lift device for a vehicle of FIG. 6A.

On the other hand, the hydraulic pressure may be supplied to the variable drive part 350 as shown in FIGS. 6A and 6B.

In the other embodiments of the present invention, the open type hydraulic circuit is constructed to drain the oil that has been withdrawn to the oil control valve 270, whereas in further embodiments of the present invention, a closed type hydraulic circuit is constructed to supply the oil that has been withdrawn to the oil control valve 370 to the hydraulic chamber 250 again.

FIG. 6A shows the state where the hydraulic pressure is supplied to the hydraulic chamber 250*a* when the valve 3 is in the high-lift state, and FIG. 6B shows the state where the hydraulic pressure is supplied to the hydraulic chamber 250*a* when the valve 3 is in the low-lift state.

In further embodiments of the present invention, first and second one-way check valves 381 and 382 are further provided between the hydraulic chamber 250*a* and the oil control valve 370.

When the valve 3 is in the high-lift state, oil pumped from an oil pump 360 is supplied to an oil control valve 370 through a first hydraulic line 361, and then is supplied to the hydraulic chamber 250*a* through a second hydraulic line 362 by opening the first check valve 381. In this case, the first check valve 381 is open by the hydraulic pressure, whereas the second check valve 382 is closed to prevent the oil from flowing into a fourth hydraulic line 364. Also, the rocker arm shaft 30 is positioned in the foremost front by the change of a driving torque of the valve 3, and the elastic member 254 is also released in the front. Accordingly, the oil is withdrawn to the oil control valve 370 through a third hydraulic line 363, and then is supplied to the second hydraulic line 362 again (See FIG. 6A).

The oil control valve 370 is driven as a general solenoid, and is composed of a spool valve 371 and a solenoid part 372 driven by current to move the spool valve 371 in forward and backward directions.

On the other hand, when the valve 3 is in the low-lift state, the spool valve 371 is moved in forward direction, and the oil pumped from the oil pump 360 is supplied to the oil control valve 370 through the first hydraulic line 361, and then is supplied to the hydraulic chamber 250*a* through a fourth hydraulic line 364 by opening the second check valve 382. In this case, the second check valve 382 is open by the hydraulic pressure, whereas the first check valve 381 is closed to prevent the oil from flowing into the first hydraulic line 361. Also, the rocker arm shaft 30 is in the rearmost position by the change of the driving torque of the valve 3, and the elastic member 254 is also in a compressed state by the pressing force of the piston 253. Accordingly, the oil is withdrawn to the oil control valve 370 through a fifth hydraulic line 365, and then is supplied to the fourth hydraulic line 364 again (See FIG. 6B).

Here, it is preferable that a backward flow prevention valve 380 is provided in the first hydraulic line 361. The backward flow prevention valve 380 is a one-way check valve that prevents the oil supplied from the oil pump 360 to the oil control valve 370 from flowing in backward direction.

In the closed type hydraulic circuit as described above, the rocker arm shaft 30, which interlocks with the drive shaft 10, is also moved in forward and backward direction, and the oil can be circulated by the moving force of the rocker arm shaft 30.

Here, the oil pump 360 only serves to supplement the amount of oil that leaks, but does not serve to move the rocker arm shaft 30.

In the structure where the oil withdrawn to the oil control valve 270 is supplied again to the hydraulic chamber 250*a* (i.e. closed type hydraulic circuit) as described above, the oil pump 360 supplements the oil through the first hydraulic line 361 only when oil leak occurs in the hydraulic chamber 250*a*, and thus the oil is less required in comparison to the open type hydraulic circuit.

As described above, according to the present invention, when the valve 3 is shifted from the high-lift state to the low-lift state, the output cam 45 can be advanced at a specified angle, and thus a pumping loss is reduced to improve the fuel consumption ratio. Also, since the advance function is provided, the exhaust-side CVVT can be deleted to greatly reduce the manufacturing cost.

In addition, since the shaft line A connecting the drive shaft 10 to the rocker arm shaft 30 crosses the shaft line B connecting the first link shaft 61 to the second link shaft 62 when the valve 3 is lifted, the close duration becomes longer than the open duration to improve the dynamic characteristics such as the acceleration characteristics, and the valve duration is minimized to heighten the performance and the fuel consumption ratio.

For convenience in explanation and accurate definition in the appended claims, the terms "upper" or "lower", "front" or "rear", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve lift device for a vehicle, the device comprising:

a drive shaft rotating in association with a crank shaft and having a drive cam formed on an outer periphery thereof;

a locker arm shaft provided apart from the drive shaft and having one end that supports a rocker arm rotating and rocking in association with the drive cam;

output cams rotatably installed on the drive shaft to interlock with the other end of the rocker arm; and a variable drive part moving the rocker arm shaft straight in a vertical direction of the rocker arm shaft to vary valve lift;

wherein the drive cam is formed eccentrically from the center of the drive shaft, and an outer vibrating race connected to the one end of the rocker arm via a connection shaft may be assembled in the drive cam so as to be freely rotatable in the drive cam.

2. The continuously variable valve lift device of claim 1, further comprising output cam link transferring the rotation of the rocker arm to the output cam;

wherein one end of the output cam link is connected to the other end of the rocker arm through a first link shaft, and the other end thereof is connected to the output cam through a second link shaft.

3. The continuously variable valve lift device of claim 2, wherein the variable drive part comprises:

a control shaft having an outer periphery on which an eccentric control cam is formed and arranged in parallel to the rocker arm shaft;

a control link connected to the eccentric control cam and the rocker arm shaft; and a motor unit rotating the control shaft.

4. The continuously variable valve lift device of claim 3, further comprising a guide part guiding the rocker arm shaft when the rocker arm shaft moves to slide in forward and backward directions by a rotating force of the control shaft.

5. The continuously variable valve lift device of claim 4, wherein the guide part comprises:

a housing having elongated holes formed in forward and backward directions on both sides thereof and a guide hole formed therein to make the rocker arm shaft movable; and a guide member supporting the rocker arm shaft through the inner hole, and guiding the rocker arm shaft as moving in forward and backward directions along the guide hole.

6. The continuously variable valve lift device of claim 2, wherein the variable drive part comprises:

a housing having elongated holes formed in forward and backward directions on both sides thereof and a hydraulic chamber formed therein to make the rocker arm shaft movable; and a piston supporting the rocker arm shaft through the inner hole, and moving in forward and backward directions in the hydraulic chamber by hydraulic pressure.

7. The continuously variable valve lift device of claim 6, wherein the variable drive part further comprises an elastic member provided in the housing to constantly push the piston in forward direction.

8. The continuously variable valve lift device of claim 7, wherein the variable drive part further comprises an oil control valve changing directions;

wherein when the valve is in high-lift state, oil supplied from an oil pump to the oil control valve through a first hydraulic line is supplied to the hydraulic chamber through a second hydraulic line to move the piston in forward direction and then is withdrawn to the oil control valve through a third hydraulic line to be drained, while when the valve is in low-lift state, the oil supplied from the oil pump to the oil control valve through the first hydraulic line is supplied to the hydraulic chamber through the third hydraulic line to move the piston in backward direction and then is withdrawn to the oil control valve through the second hydraulic line to be drained.

9. The continuously variable valve lift device of claim 7, wherein the variable drive part further comprises an oil control valve changing directions, and first and second one-way check valves;

wherein when the valve is in high-lift state, oil supplied from an oil pump to the oil control valve through a first hydraulic line is supplied to the hydraulic chamber through a second hydraulic line by opening the first check valve, and when the rocker arm shaft is moved in forward direction by a change of a driving torque of the valve, the oil is withdrawn to the oil control valve through a third hydraulic line and then flows again to the second hydraulic line, while when the valve is in low-lift state, the oil supplied from the oil pump to the oil control valve through the first hydraulic line is supplied to the hydraulic chamber through a fourth hydraulic line by opening the second check valve, and when the rocker arm shaft is moved in backward direction by the change of the drive torque of the valve, the oil is withdrawn to the oil control valve through a fifth hydraulic line and then flows again to the fourth hydraulic line.

10. The continuously variable valve lift device of claim 8, wherein a backward flow prevention valve is installed on the first hydraulic line.

11. The continuously variable valve lift device of claim 9, wherein a backward flow prevention valve is installed on the first hydraulic line.

12. The continuously variable valve lift device of claim 2, wherein when the valve is in a high-lift state or in a low-lift state, a shaft line A connecting the drive shaft to the rocker arm shaft is arranged to cross a shaft line B connecting the first link shaft to the second link shaft.

* * * * *